United States Patent [19]

Pichl

[11] 4,177,747

[45] Dec. 11, 1979

[54] OUTBOARD MOTOR BRACKET ASSEMBLY

[75] Inventor: Heinz Pichl, Upsala, Sweden

[73] Assignee: Ab Volvo Penta, Gothenburg, Sweden

[21] Appl. No.: 827,005

[22] Filed: Aug. 23, 1977

[30] Foreign Application Priority Data

Aug. 27, 1976 [SE] Sweden ..... 7609500

[51] Int. Cl.[2] ..... B63H 21/26

[52] U.S. Cl. ..... 115/41 HT; 248/642

[58] Field of Search ..... 115/41, 17, 18 R, 12 A, 115/35; 248/4, 640, 642

[56] References Cited

U.S. PATENT DOCUMENTS

| | | | |
|---|---|---|---|
| 2,718,866 | 9/1955 | Kiekhaefer | 115/18 R |
| 3,073,279 | 1/1963 | Moody | 115/41 HT |
| 3,106,375 | 10/1963 | Donaldson | 248/4 |
| 3,486,724 | 12/1969 | Adamski | 248/4 |
| 3,576,173 | 4/1971 | Ginnow | 115/17 |
| 3,839,986 | 10/1974 | Meyer et al. | 115/41 HT |
| 3,951,090 | 4/1976 | Potter | 115/41 HT X |

*Primary Examiner*—Trygve M. Blix
*Assistant Examiner*—Sherman D. Basinger
*Attorney, Agent, or Firm*—George H. Baldwin; Arthur G. Yeager

[57] ABSTRACT

A trimming, tilting and transom bracket assembly for a drive leg for a boat including a single tilt pin supportingly carried by a transom bracket, a swivel bracket tiltably carried by the tilt pin steerably supporting the leg, a member carried by the pin interposed between the transom bracket and the swivel bracket, and trim adjusting elements between the transom bracket and such element and trim adjusting elements between such element and the swivel bracket.

24 Claims, 6 Drawing Figures

12a
11
12
11b
11a
60a
10
61
50c
P
42
60z
60
41
40
60a
60f
50
61
MA
13
60y
20
70
21
21e
21f
50a
60x
51
SA
19
17
17a
PA

OUTBOARD MOTOR BRACKET ASSEMBLY

The invention relates to an outboard motor bracket assembly of the type wherein a motor, which is provided with a drive leg, is steerably, trimably and tiltably attached to the transom of a boat, a first motor bracket part being swingable about an essentially horizonal axis attached to the said transom, and the motor itself being rotatably attached to a second motor bracket part displaceable about an essentially horizontal axis relative to such first part and co-operating therewith. Trimming is used herein to refer to the relatively small and tilting to refer to the larger swinging movement of the outboard motor around a tilt axis to adjust the motor, and accordingly the propeller, in an optimum driving trim position, or for tilting the motor into a rest position in which, typically, the propeller is entirely out of the water.

The trimming and the tilting may be accomplished manually, but it is also contemplated that a cylinder-piston unit may be arranged between the upright steering axis, the axis around which the motor is swung horizontally or laterally for the steering of the boat, and the boat transom, or an attachment attached to the transom, such cylinder-piston unit being driven by a pressurized fluid supplied from a pump provided with a reservoir and located on the bracket assembly or inside the boat, whereby the trimming and the tilting may be remotely controlled, for instance from a driver's station located forwardly in the boat.

An object of the present invention is to provide an improved bracket assembly of the type above mentioned especially wiith a view to an improvement of the trimming action and improved ease of operation.

According to the invention, not only are the trimming and tilting operations entirely separate, since the tilting takes place merely between the first and the second part of the bracket assembly, but there also exist two separate trimming possibilities, that is between the boat transom and the first part and between this first part and the second part, such trimming possibilities being in addition to the tilting possibility.

The first part as well as the second part are swingable around a substantially horizontal axis which may be embodied in a separate tilt pin for each of the two parts, or the axes may be coincident and, in this case, each part may be mounted on and swing vertically about the axis of a single tilt pin. The single tilt pin arrangement is to be preferred, wherein the single tilt pin is mounted to the transom bracket, and thus to the boat. The bracket fixed to the transom includes an elongated bearing yoke, extending substantially horizontally, in the legs of the yoke the tilt pin is mounted, while between the yoke legs, the first part is mounted, and outside the legs, the second part is mounted on the tilt pin.

Preferably, the tilt pin is mounted slightly forwardly of the transom, which brings about certain advantages, particularly in that the inclination of the motor, thus achieved is such that the drive shaft of the motor, as well as the steering axis, are rearwardly inclined in the downward direction. Compared with the conventional arrangement, where the axis of the tilt pin intersects the steering axis, the angle through which the motor has to be tilted upwardly so that the lowermost portion of the leg will be lifted to the level of the bottom of the boat, will be smaller due to the altered geometrical conditions. Furthermore, as a result of the favorable mutual position of the tilt pin relative to the center of gravity of the motor, a smaller force is required to tilt the motor upwards a certain number of degrees, and the greater the forward displacement of the tilt axis with respect to the steering axis, the more noticeable this advantage becomes.

Furthermore and preferably, the tilt pin may be so designed as to be able to accommodate the end portion of a known co-axial cable-control device. Specifically, the tilt pin is preferably made as a tube, in the interior of which the end portion of the steering cable casing may be fixed. The active core of the control device which terminates in a rod movable with the core, is attached via a shaft to an arm portion of the motor.

The device according to the invention is particularly adapted to be supplemented by a simple novel tilt or reverse lock which will be described further in connection with the embodiment disclosed.

The device according to the invention is especially well suited for being complemented by at least one extensible expansible chamber device, such as a cylinder-piston assembly, between the boat transom and the first tiltable motor bracket part, and/or between such first part and the second tiltable motor bracket part.

Such expansible chamber device, or cylinder piston assembly or assemblies may be arranged for serving different purposes, and in the first place for the remote control of the trimming and tilting of the motor from the driver's station. It is furthermore contemplated that a cylinder-piston assembly disposed between the first bracket part and the second bracket part may be designed as a gas-filled shock absorber to cushion the return of a motor which has been tilted, such as by striking an underwater object, to its normal upright drive position. The cylinder may, for example, be filled with a fixed amount of gas, or connected to an accumulator which, with the cylinder, contains such fixed amount of gas, such that the cylinder balances all or some of the weight, or downward gravitational force, of the motor when in its tilted position. The device according to the invention allows to a large extent the use of pressmolded details which do not require subsequent working or finishing, whereby the production costs are minimized.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

Figure 1:
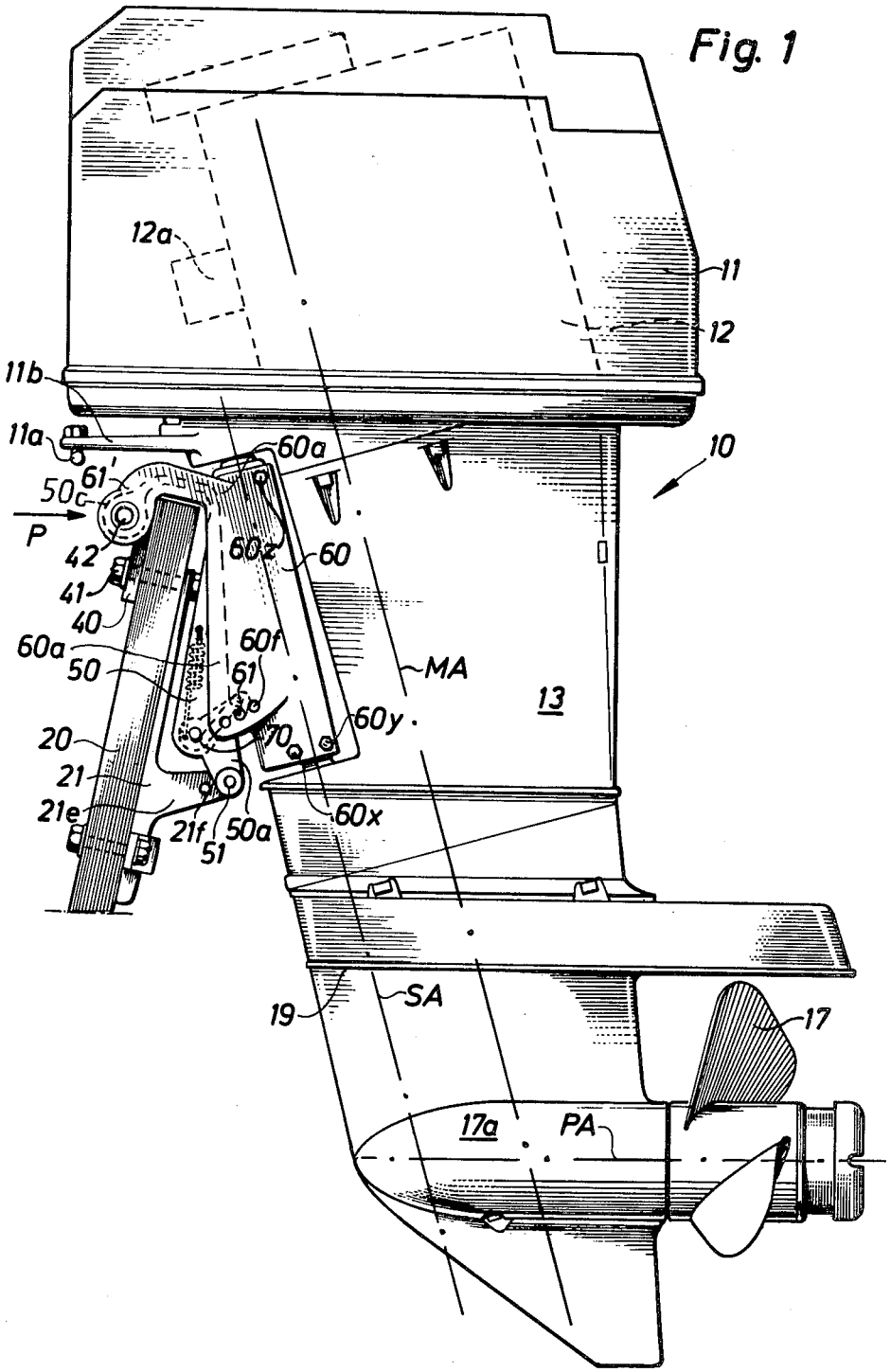
FIG. 1 is a side elevational view, with certain parts shown in broken lines, of an assembly according to the present invention, adapted for manual trimming and tilting.

According to FIG 1, an outboard motor 10 comprises a motor housing or shroud 11, under which the motor 12 itself is accommodated, and a leg housing 13, in which the output drive shaft, symbolically indicated by its axis MA, of the motor 12 extends, which in the propeller gear housing 17*a* transfers its rotation to the propeller shaft represented by its axis PA, on which the propeller 17 is attached. On the external side of the leg there is arranged an anti-cavitation plate 10. The motor is provided with an outwardly and forwardly extending steering arm 11*b* which carries an outer end ball attachment 11*a* for attaching the inner operating part or core 11*e* of a coaxial remote control single, push-pull steering cable 11*f*. The motor 12 carries, preferably under shroud 11, a servo-motor 12*a*, the purpose of which will be explained later.

Figure 2:
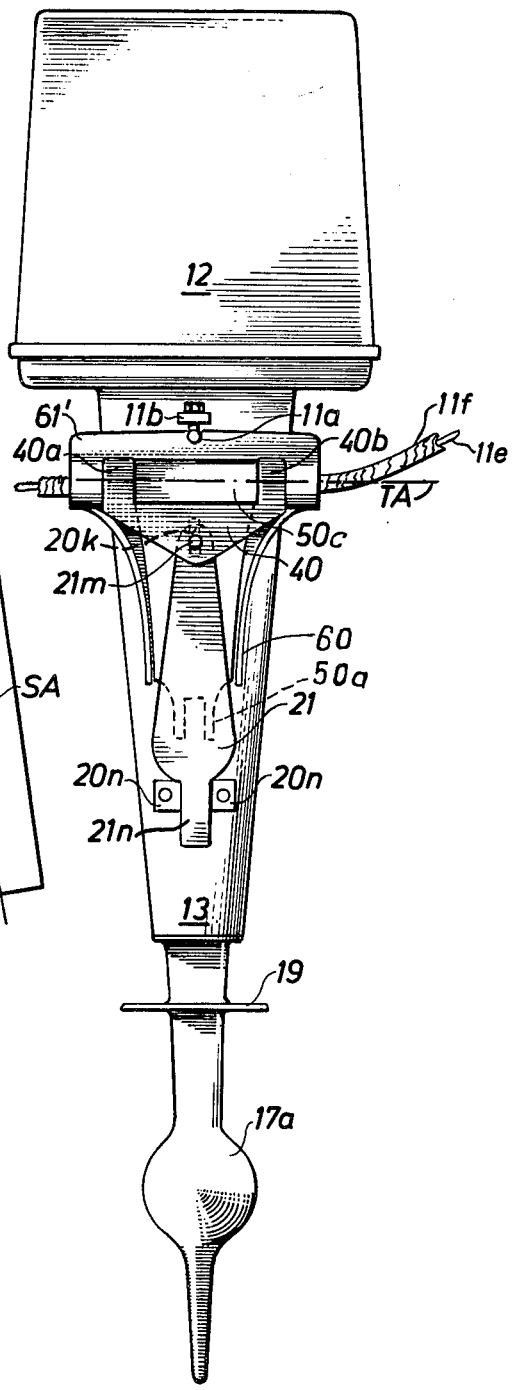
FIG. 2 is a front view taken in the direction of the arrow P of FIG. 1 of the same assembly, not showing however the transom of the boat.

A bearing yoke 40 is screwed onto the transom 20 of a boat by means of a screw bolt 41. The two legs 40*a*, 40*b* (FIG. 2) of the bearing yoke 40 carry a tilt pin 42 which extends, preferably rotatably therethrough. The tilt pin is symbolically indicated in FIG. 2 by its axis TA. Preferably this tilt pin is in the form of a tube, so that in the interior thereof the end portion of the casing of a single-cable control device may be attached. The control element or core, which may terminate in a projecting rod, is linked by known means to the ball attachment 11*a* of the motor 10.

On the tilt pin 41 two construction elements are swingable journalled: on the middle portion thereof, i.e. between the legs 40*a*, 40*b* a first part 50 is carried while on the outer end portions, i.e. on the outer sides of the legs 40*a*, 40*b*, a second part 60 is mounted. The second part 60 comprises, as shown, a yoke-shaped support element 61 of which the legs, which are engaged on the pin 42, are disposed outwardly of the legs 40*a* and 40*b*, respectively. The second part 60 suppports the steering shaft of the motor, which in FIG. 1 is indicated symbolically by its axis SA. Preferably, the second part 60 is made of two symmetrical halves, which are mounted together by means of attachment bolts, such as bolts 60*x*, 60*y* and 60*z*.

Figure 3:
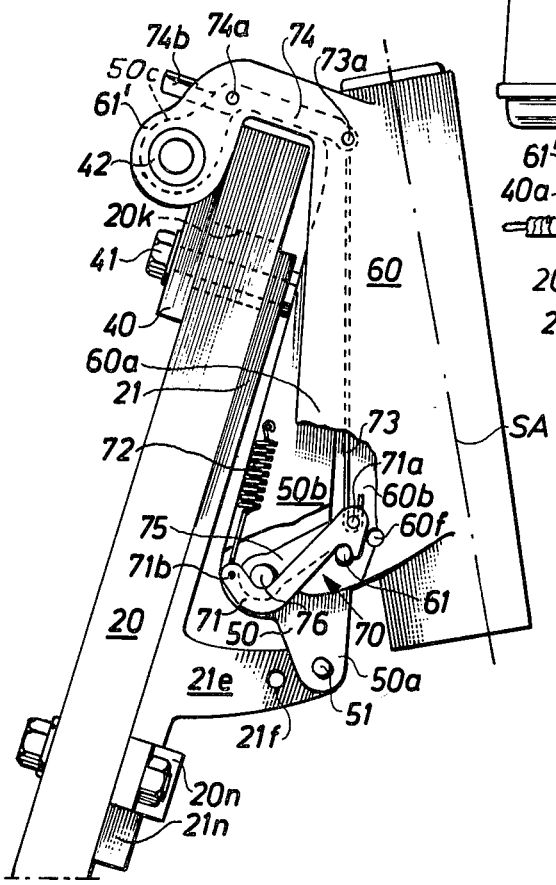
FIG. 3 is a fragmentary view on an enlarged scale of a portion of the assembly of FIG. 1 with certain parts broken away.

The first part 50 is at its lower end 50*a* adjustably connected to the transom 20 by means of a pin 51 selectively positioned in one or another of the holes 21*f* in an arm 21*e* which protrudes from a transom plate member 21. In this manner one trimming possibility is obtained. The second part 60 is also provided with a row of several holes 60*f*. A pin 61 is positioned in a selected hole 60*f*, the pin being located in the middle hole in FIGS. 1 and 3. A second trimming possibility is obtained by this arrangement. To prevent tilting-up of the motor when driving in reverse, and at the same time to afford such tilting-up when an underwater obstacle is hit during forward driving, as well as when desired when the boat is standing still, a tilt for reverse lock 70 is arranged on the first part 50 for locking the part 60 thereto. As seen in FIG. 3, the reverse lock 70 comprises essentially a straight link 75 and an S-shaped hook member 71, which at its forward bent portion curves under and engages upwardly a pin 76 which passes through a hole in the link 75 and in the yoke member or first part 50. The hook 71 has a rearward downwardly inclined bend portion which extends, when the leg is in operating position, above and engages downwardly on a pin 61 which is positioned in a desired one of holes 60*f*, and which such pin is thus rigidly connected to the second part 60. In the internal space 50*b* of the first part 50 tension spring 72 is disposed with its upper end anchored to the part 50, and with its lower end attached to the hook 71 at a place 71*b* at the terminal portion of the upwardly bent front portion thereof, forwardly of the pin 76. An elongated pulling element or link 73 is connected to the hook member 71 rearwardly of the pin 76 about which the hook member is rockable, and, preferably, at a point generally aligned above the area of contact of the hook with pin 61, such as by means of the attachment pin 71*a*. The link 73 extends upwardly within the interior space 60*b* of the second part 60 to an attachment 73*a* at its upper end to the rearward end portion of an operating lever member 74. Lever member 74 is pivotally mounted between its ends on a pin 74*a* to the first part 50 and terminates forwardly in a manually engageable button or tab portion 74*b*, such that depression of tab 74*b* causes the lever 74 to rock on pivot pin 74*a* in a direction to raise link 73 and thus to raise the rearward hook end of hook member 71 free of pin 61 against the bias of spring 72, thereby to free the second part 60 for upward and rearward tilting of the motor. When the motor strikes an underwater object, the force of the pin 61 against the inner inclined surface of the hook at its engagement with the pin by cam action overcomes the biasing force of spring 72 causing the hook member 71 to rock about pin 76 into a position to free the lock pin 61 and thus to permit upward swinging of the motor.

The upper portion of the transom bracket 21 is provided with a round hole 21*m* for the transom attachment bolt 41 and at its lower end it is provided with a guide tongue portion 21*n*. By letting the screw bolt 41 pass through the transom 20 in an upwardly and downwardly oriented elongated transom slot 20*k*, which slot is located above the water line, the entire bracket assembly may be mounted height-adjustably. The guide tongue portion 21*n* is transversely caged between two guide elements 20*n* bolted to the transom.

It will be appreciated that the side forces, which act on the second part 60 when steering to the side, are effectively transferred to the transom 20 in that the side wings 60*a* of the second part 60 abut against corresponding side surfaces on the first part 50, and the bifurcated lower part 50*a* of this first part 50 itself abuts against the arm 21*e* of the transom bracket 21, whereafter the side forces are taken up the guiding or caging elements 20*n* which are bolted to the transom 20. Simultaneously, the side wings 60*a* provide a favorable lateral fixation of possible cylinder-piston assembly 65 (FIG. 5) mounted between the first and the second parts.

Figure 4:
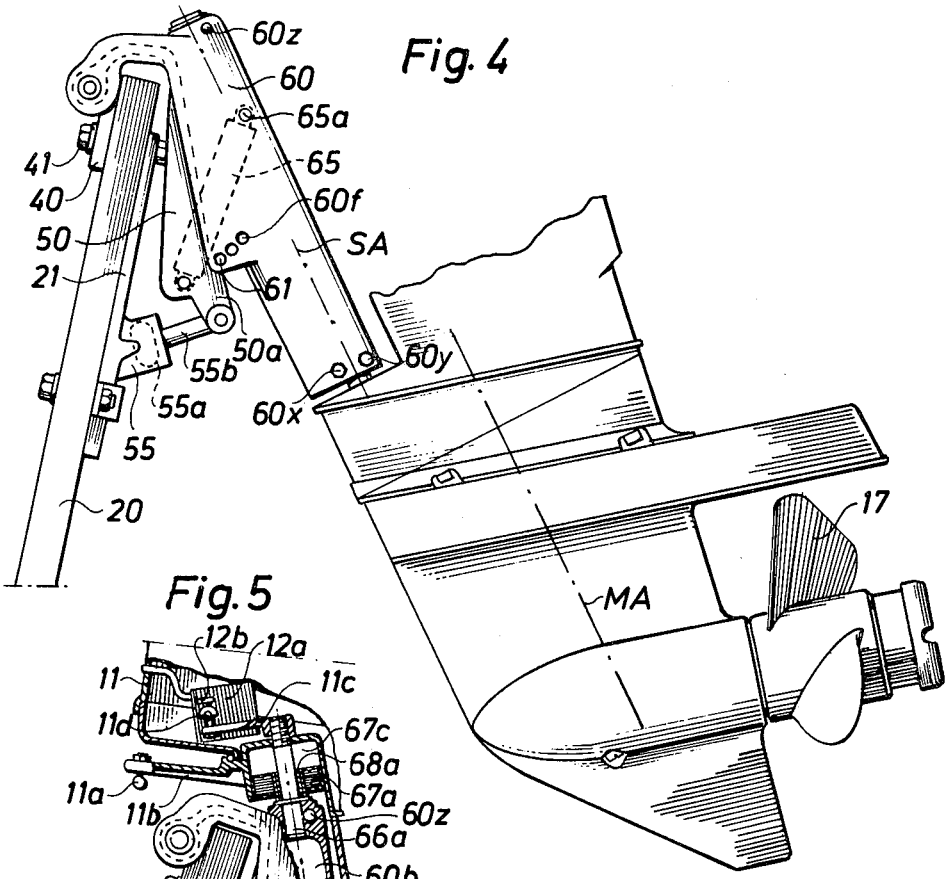
FIG. 4 is a side elevational view of a bracket assembly, with the motor represented in fragment, according to a modified embodiment of the invention, the motor being in maximum rearward trim position.

In the embodiment according to FIG. 4, the arm 21*e* and the row of holes 21*f* have been replaced by a first cylinder-piston assembly 55 extending between the transom 20 and the transom bracket plate 21, on the one hand, and the lower portion 50*a* of the first part 50, on the other hand. By remote control of this assembly, for instance from a forwardly located driver's station it is possible while the boat is being driven to adjust the trim to provide the correct propeller position for the particular speed loading and other conditions. The basic trimming, i.e. the adaption to different boat types having differently inclined transoms, is carried out when first mounting the motor on the particular boat by means of the row of holes 60*f* and of the pin 61. The pin 61, in the arrangement as shown in FIG. 4, has been selectively placed in the forwardmost hole. With a more inclined transom, it might be placed in the second hole 60*f*, for example.

For tilting up, there is connected between the first part 50 and the second part 60, and disposed in the interior spaces 50*b*, 60*b* thereof (FIG. 3), a second cylinder-piston assembly 65. This assembly, by means of a pin 65*a*, is swingably attached to the second part 60, and this assembly can also be remotely controlled from the driver's station. The cylinder-piston assemblies 55, 65 are supplied from a source of pressurized fluid which may be arranged either in the boat or, as taught in my copending application Ser. No. 827,004 filed concurrently herewith, now U.S. Pat. No. 4,119,054, under the motor housing 12. For the sake of clearness, neither said source nor the conduits belonging thereto are shown. The side surfaces 55*a* of the piston in the assembly 55 preferably bow outwardly, that is, the piston may be an O-ring piston, so that the piston rod 55*b* may perform the necessary smaller angular movements. Alternatively, this piston rod may be attached to the portion 50*a* by means of an elongated slot, or the assembly may be replaced by a rubber bellows.

Instead of a single cylinder-piston assembly 65, two adjacent parallely connected cylinder-piston units in a double assembly may be preferred, especially in connection with heavier motors.

In a manner known per se, this second cylinder-piston assembly 65 also can be arranged for performing the function of a hydraulic reverse lock, by providing valves to close off the hydraulic connections to the cylinder.

It will be understood that the cylinder-piston assemblies also may be used in one place only i.e. between the transom bracket and the first part, or between the first part and the second part, while the setting at the other place is then carried out mechanically in a manner according to FIG. 1.

It is known to design cylinder-piston assemblies in an outboard motor as shock absorbers and to fill the cylinder or cylinders with a gas, the pressure of which, acting on the piston completely or partially balances out the weight of the motor when the motor is tilted upwards. According to the present invention, the cylinder-piston assembly or assemblies between the first part and the second part may be arranged similarly, i.e. for performing also a shock-absorption function, in addition to their lifting function.

In the embodiment according to FIGS. 1 and 3, the steering shaft with the axis SA may be undivided, i.e. an integral unit from the upper to the lower end. When the second cylinder-piston assembly 65 is used, the steering shaft is, however, divided according to FIG. 5 preferably into an upper pivot pin 66*a* journalled in an upper pivot bearing 68*a* and a lower pivot pin 66*b* journalled in a lower pivot bearing 68*b*. In this way, enough space is obtained in the interior space 60*b* of the second part 60 for the attachment of the assembly 65, partly, also, thanks to the above described back rearward inclination of the steering axis. In a manner known per se, the pivot pins 66*a*, 66*b* are at 67*a*, 67*b* resiliently mounted in the leg 13 to achieve vibration absorption.

Basically, the pivot bearings for the upper and lower portions of the steering shaft may be mounted alternatively in the second part 60, rather than to the motor 10 and the leg 13 as shown. The last mentioned situation, as illustrated in the drawings brings about however, a number of advantages.

Figure 5:
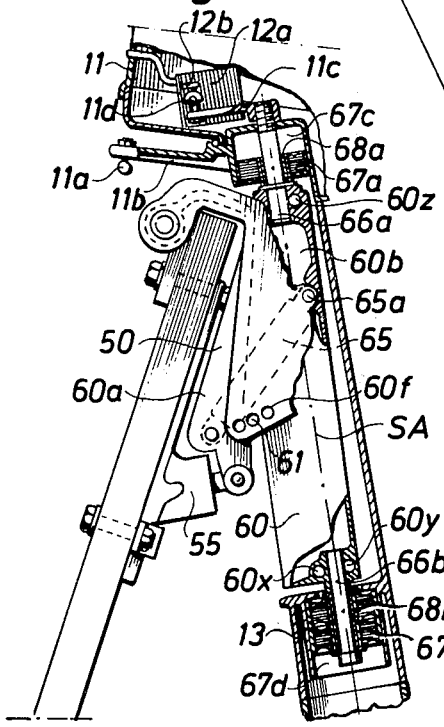
FIG. 5 is a partially broken away detail view of the bracket assembly according to FIG. 4, showing the motor in a position of less trim.

The second part 60, as shown in FIGS. 4 and 5, includes two symmetrical halves which are screwed together by bolts such as 60*x*, 60*y*, 60*z*. By this bolted connection also pivot pins 66*a*, 66*b* are fixed in position in the two halves, in that the bolts 60*y* and 60*z* pass through notches interrupting the cylinder surfaces of the pivot pins, so that the pivot pins are locked against rotation in the second part 60. The pivot bearings 68*a*, 68*b* are embedded in rubber blocks 67*a*, 67*b* for vibration-absorption, as mentioned above. This arrangement has the additional advantage that the two pivot pins 66*a*, 66*b* need not be especially well aligned, since small deviations are compensated by the rubber blocks. The construction shown has further the spare spaces 67*c*, 67*d* which make it possible that a varying number of rubber blocks may be mounted on the pivot pins (for instance a greater number with slower boats and motors, and a smaller number with faster motors).

Figure 6:
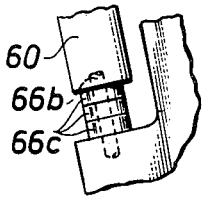
FIG. 6 is a detail view, on an enlarged scale, of a fragment of the bracket assembly of FIG. 5, showing means for adjusting the depth of the propeller with respect to the transom bracket.

In order to enable compensation for different heights of transoms of different boat types, it is known to provide outboard motors with a so called extended or long leg. FIGS. 5 and 6 disclose that the same effect easily may be obtained with the assembly according to the present invention in that spacing members, for instance washers 66*c*, may be slipped onto the upper and/or lower pivot pin, for instance in the manner schematically shown in FIG. 6 for the lower pivot pin. When such spacing washers are slipped over the lower pin, the leg will be lowered with respect to second part 60, thus to compensate for a taller transom, that is to say, a transom which carried the tilt pin 42 higher with respect to the water level, while, if fewer spacing washers are positioned on the lower pivot pin and more such washers are so positioned on the upper pin, the leg will be effectively shortened to adapt the motor and its mounting to a lower transom height. It will be appreciated that an analogous construction, for the same purposes also may be used when the pivot bearings are mounted in the second part. Necessary for this adjustment facility is that the distance between the two shoulders on the motor, between which the second part is inserted, is made longer than the length of the second part. This adjustment facility is of course a replacement for, and/or a supplement to, the facility obtained by the elongated slot 20*k* (FIG. 3) when the steering shaft is undivided. Regardless however, in which way the spacing washers are distributed between the upper and lower pivot pins, the increased mutual spacing between the rubber blocks 67*a* and 67*b* brings about the advantage of an increase vibration attentuating effect.

In FIG. 5 two alternative steering possibilities of the motor 10 are shown. On the one hand, it is the already described outer steering possibility, where a not shown rod of a push-pull sngle cable control system is attached to the ball attachment 11*a* on an outer steering arm 11*b*. On the other hand there is provided in addition an inner steering arm 11*c* under the motor housing or shroud 11, and the arm 11*c* carried an inner ball attachment 11*d*, the arm 11*c* being rigidly attached to the upper pivot pin 66*a*. A remotely operated control member, for instance an electrical servo-motor 12*a*, is fixedly attached to the motor 12 (FIG. 1) or to an element rigidly connected thereto. The control member drives an operating rod 12*b*, the one end of which is connected to the inner ball attachment 11*d*.

In that the arm 11*c* is rigidly attached to pivot pin 66*a*, and the pivot pin is fixed by bolt 60*z* against rotation with respect to the bracket assembly, and is thus non-rotatable on its axis with respect to the boat, the arm 11c does not swing in a steering direction about axis SA.

By displacing the operating rod 12b with the arm of the servo-motor 12a in a desired extent in a lateral direction perpendicular to the plane of the drawing, an inside power steering is obtained controllable by remote electrical or hydraulic controls for the servo-motor.

While in FIG. 4 the motor 10 is shown in its extreme outward trim position, where the piston of the first cylinder-piston assembly 55 is maximally extended and the pin 61 is located in the forward one of the hole 60f, in FIG. 5 the motor is shown in a medium trim position where said piston has movement possibilities in both directions and the pin 61 is placed in the middle one of the holes 60f.

It will be appreciated that according to the present invention the basic or rough trimming that, the adaptation to different transom inclinations, may be carried out either between the transom bracket and the first part, as is specifically contemplated in the embodiment according to FIGS. 1 and 3, or between the first and the second parts, as is specifically contemplated in the embodiment according to FIGS. 4 and 5, while the fine trimming is, of course, executed between the other pair of said elements.

To a great extent, the device according to the invention allows the use of precision molded construction elements which require no subsequent machining or finishing whereby the production costs are minimized.

While the invention has been described with respect to certain specific embodiments, it will be appreciated that many modifications and changes may be made by those skilled in the art, without departing from the spirit of the invention. It is intended, therefore, by the appended claims to cover all such modifications and changes as fall within the spirit and scope of the invention.

What is claimed as new and what it is desired to secure by Letters Patent of the United States is:

1. A bracket assembly for trimmably and tiltably attaching a drive leg to the transom of a boat, a first part of the bracket assembly being attached to said transom and swingable about an essentially horizontal lateral axis and the drive leg itself being steerably attached to a second part of the bracket assembly, said second part being displaceable relative to said first part and cooperating therewith, characterized in that a device for the adjustment of the trim position of said drive leg is connected between said transom and said first part, said second part is pivotable about an essentially horizontal tilt pin and a second device for the adjustment of the trim position of the leg is connected between said first and second parts, the axis of said tilt pin being coincident with said lateral axis, said second part is arranged for being tilted-up about said tilt pin relative to said first part up to the extreme tilt-up position of said drive leg and for returning into the operating trim position adjusted by said second trimming device, said drive leg is attached to said second part for rotation about a steering axis but fixedly with respect to relative movement about said tilt pin, so that said drive leg takes part in all tilt movements of said second part about said essentially horizontal pivot axis.

2. An assembly according to claim 1, in which said first and second parts are pivotally mounted on a single tilt pin common to both of them.

3. An assembly according to claim 2 characterized in that said tilt pin is arranged at the forward side of the transom.

4. A bracket assembly for trimmably and tiltably attaching a drive leg to the transom of a boat, a first part of the bracket assembly being attached to said transom and swingable about an essentially horizontal lateral axis and the drive leg itself being steerably attached to a second part of the bracket assembly, said second part being displaceable relative to said first part and cooperating therewith, characterized in that a device for the adjustment of the trim position of said drive leg is connected between said transom and said first part, said second part is pivotable about an essentially horizontal tilt pin and a second device for the adjustment of the trim position of the leg is connected between said first and second parts, said second part is arranged for being tilted-up about said tilt pin relative to said first part up to the extreme tilt-up position of said drive leg and for returning into the operating trim position adjusted by said second trimming device, said drive leg is attached to said second part for rotation about a steering axis but fixedly with respect to relative movement about said tilt pin, so that said drive leg takes part in all tilt movements of said second part about said essentially horizontal pivot axis, said tilt pin being journalled in two bearings arranged in support leg portions of an elongated and substantially horizontal bearing yoke, and said first part being journalled on the tilt pin in the space between the internal sides of said leg portions, while said second part is journalled on the tilt pin outwardly of the outer sides of said leg portions.

5. An assembly according to claim 1 characterized in that the tile pin is arranged at the forward side of the transom.

6. An assembly according to claim 1 characterized in that said tilt pin is hollow for accommodating the end portion of a single cable remote steering control.

7. An assembly according to claim 4 characterized in that said tilt pin is hollow for accommodating the end portion of a single cable remote steering control.

8. An assembly according to claim 1 having a spring loaded tilt and reverse lock characterized in that the lock comprises a substantially horizontally forwardly and rearwardly extending S-shaped hook which by means of its rearward bend engages from above downwardly on a first substantially horizontal transverse pin which is fixedly attached to the lower portion of said second part, and which by means of its front bend engages upwardly from below a second substantially horizontal transverse pin on the lower part of said first part, and in that at the terminal portion of said front bend forwardly of said second pin a tension spring element extends upwardly and which has an upper end attached to said first part and that at said rear bend an upwardly extending pulling member is attached to the hook, said pulling member having an upper end connected to a movable operation member for said lock.

9. An assembly according to claim 1 characterized in that one of said devices comprises a cylinder-piston assembly.

10. An assembly according to claim 9 characterized in that the first of said devices comprises a cylinder-piston assembly.

11. An assembly according to claim 9 characterized in that said drive leg and said second part are connected by two bearings spaced apart along said steering axis and a cylinder-piston tilt assembly extends through the space between said bearings.

12. An assembly according to claim 9 characterized in that said cylinder-piston assembly is hydraulicly actuated.

13. An assembly according to claim 1 characterized in that a cylinder-piston tilt assembly is connected between said first and second parts.

14. An assembly according to claim 12 wherein said cylinder-piston tilt assembly comprises a shock absorber assembly.

15. An assembly according to claim 1 characterized in that said bracket assembly comprises a plate engageable against the rear face of the transom, a second plate engageable with the forward face of the transom, each said plate being provided with a hole and said plates being disposed with said holes in alignment, said transom having an upwardly and downwardly oriented slot between said holes, an attachment element extending through said slot and moveable therealong and extending fittingly through each said hole for clamping said plates to said transom, said tilt pin being supported on said second plate.

16. An assembly according to claim 1 characterized in that said second part comprises an elongated sleeve having a respective journal pin at each end along said steering axis extending outwardly respectively upwardly and downwardly of said sleeve, said pins being spaced apart and each being individually affixed to said sleeve and said drive leg comprises a respective bearing element on each said pin.

17. An assembly according to claim 16 characterized in that a respective rubber block surrounds each said bearing element and connects the respective bearing element to said drive leg.

18. The assembly according to claim 16 characterized in that said sleeve is shorter than the distance between said bearings and removable spacing washers are arranged on one and the other of said pins selectively to adjust the height of said drive leg with respect to said second part.

19. An assembly according to claim 16 characterized in that the upper said pivot pin is non-rotatably attached to said second part, a steering arm is rigidly attached to said upper pivot pin, a servo motor is attached to said leg, and an operating element connects said motor to said arm.

20. An assembly according to claim 19 characterized in that a drive motor is carried by said drive leg, said motor is provided with a shroud, and said servo motor is disposed under said shroud.

21. An assembly according to claim 1 characterized in that a yoke element is provided to carry said tilt pin, said yoke element being provided with a bolt hole therethrough and said transom being provided with a vertically oriented slot for said bolt, and a mounting bolt through said slot and hole for connecting said element in adjustable height position to said transom.

22. An assembly according to claim 1 characterized in that said second part is provided with side wings abutting against corresponding side-surfaces of said first part in order to transfer side steering forces therebetween.

23. An assembly according to claim 1 characterized in that a drive motor is carried by said drive leg.

24. A bracket assembly for trimmably and tiltably attaching a drive leg to the transom of a boat, a first part of the bracket assembly being attached to said transom and swingable about an essentially horizontal lateral axis disposed forwardly of said transom and the drive leg itself being steerably attached to a second part of the bracket assembly, said second part being displaceable relative to said first part and co-operating therewith, characterized in that a device for the adjustment of the trim position of said drive leg is connected between said transom and said first part, said second part is pivotable about an essentially horizontal tilt pin and a second device for the adjustment of the trim position of the leg is connected between said first and second parts, said second part is arranged for being tilted-up about said tilt pin relative to said first part up to the extreme tilt-up position of said drive leg and for returning into the operating trim position adjusted by said second trimming device, said drive leg is attached to said second part for rotation about a steering axis but fixedly with respect to relative movement about said tilt pin, so that said drive leg takes part in all tilt movements of said second part about said essentially horizontal pivot axis.

* * * * *